US006866247B2

(12) United States Patent
Thompson

(10) Patent No.: US 6,866,247 B2
(45) Date of Patent: Mar. 15, 2005

(54) NAIL PULLING HAMMER AND HAMMER HEAD

(76) Inventor: Harold Thompson, 1944 Frank Moore Rd., Culleoka, TN (US) 38451

( * ) Notice: Subject to any disclaimer, the term of this patent is extended or adjusted under 35 U.S.C. 154(b) by 0 days.

(21) Appl. No.: 10/423,119

(22) Filed: Apr. 25, 2003

(65) Prior Publication Data

US 2004/0211944 A1 Oct. 28, 2004

(51) Int. Cl.[7] ..... B25C 1/00
(52) U.S. Cl. ..... 254/26 R; 81/20
(58) Field of Search ..... 254/26 R, 26 E, 254/27, 25; 81/20

(56) References Cited

U.S. PATENT DOCUMENTS 455,776 A * 7/1891 Street ..... 254/26 R
668,046 A * 2/1901 Innes ..... 254/26 R
3,150,858 A * 9/1964 David ..... 254/26 R
3,680,834 A 8/1972 Holloway
4,039,140 A 8/1977 Pulliam
4,042,210 A 8/1977 Feldman
4,520,997 A * 6/1985 Lorton, Sr. ..... 254/26 R
4,776,568 A 10/1988 Perel
4,798,366 A 1/1989 Pearson et al.
4,826,136 A 5/1989 Thomas
5,207,126 A 5/1993 Schaben
5,280,676 A 1/1994 Fieni
5,749,113 A 5/1998 Witter
5,855,358 A 1/1999 Witter
6,032,927 A 3/2000 Atkinson
2004/0074342 A1 * 4/2004 Pace et al. ..... 81/20

* cited by examiner

*Primary Examiner*—Lee D. Wilson

(57) ABSTRACT

A hammer that includes a handle and a head that includes a claw, a strike face and a channel dimensioned to receive and remove a nail.

21 Claims, 13 Drawing Sheets

NAIL PULLING HAMMER AND HAMMER HEAD

BACKGROUND

The invention relates to pulling nails using hammers.

Commercial carpentry hammers often include what is referred to as a "v-claw" located on the back of the hammer head. Hammer claws are available in a variety of configurations including rip claws, straight claws and curved claws. Although these claws are able to remove a variety of nails having varying nail lengths, they are not easily adapted to remove longer nails.

Methods have been developed in an attempt to improve the ability of existing hammers to remove longer nails. One such method involves placing a block of wood under the hammer head after having partially removed the nail from the work surface. The wood serves to raise the hammer fulcrum, which then provides sufficient leverage for removing longer nails. Although this approach works in some cases, carpenters are not always in close proximity to blocks of wood and often do not have a free hand available during nail removal. This situation can arise when working on a ladder, high wall area, roof or ceiling, or when holding the work piece so that it will not fall or become damaged when the nail is removed.

A number of devices have also been developed to enable the removal of longer nails. These devices include nail pulling devices, e.g., hammers and pry bars, having multiple components, multiple claws and a variety of claw configurations. Many of the components that have been developed to enhance long nail removal are designed to attach to an existing nail pulling device. The additional components tend to increase the weight and cost of the nail pulling device and may mechanically compromise the integrity of the device during use.

SUMMARY

The invention features a tool that is capable of pulling nails of various lengths without the need for additional tools. The tool can be in the form of a standard v-claw fulcrum.

The hammer is capable of removing a variety of nail heads, sizes and lengths.

The hammer can be constructed to exhibit reduced overall weight relative to a standard hammer while providing sufficient hammer head strength.

The hammer enables the one hand removal of longer nails.

The exact nature of this invention, as well as its objects and advantages will become readily apparent upon reference to the following detailed descriptions when considered in conjunction with the accompanying drawings, in which like reference numerals designate like parts throughout the figures thereof.

Other features of the invention will be apparent from the following description of preferred embodiments thereof, and from the claims.

DETAILED DESCRIPTION

Figure 1:
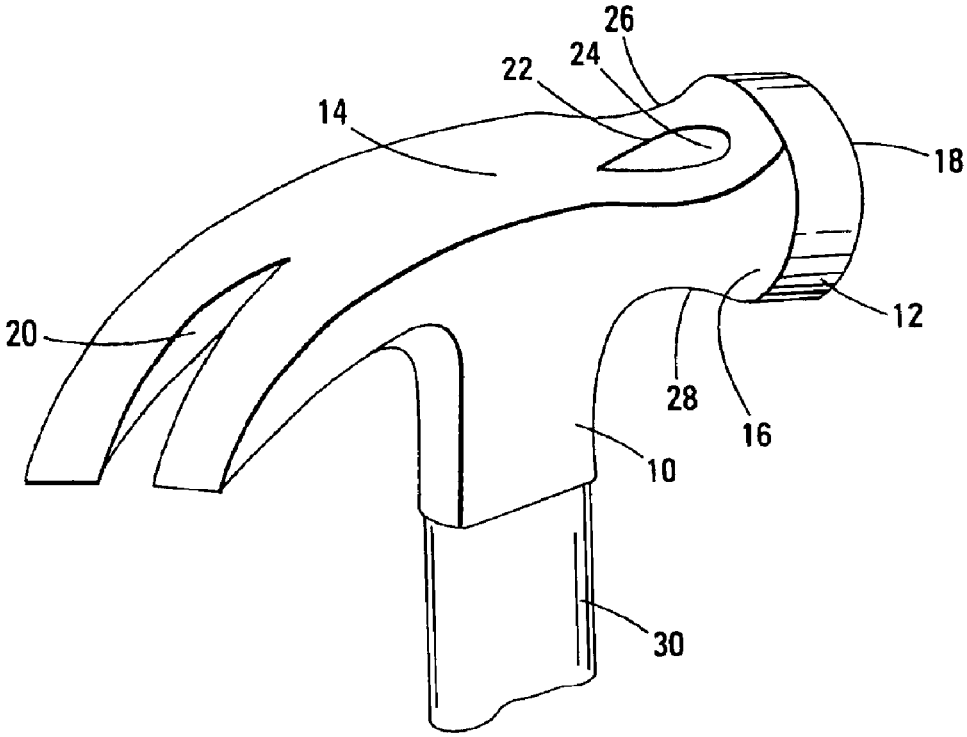
FIG. 1 is a partial perspective view of the head of the hammer of the present invention.
Figure 2:
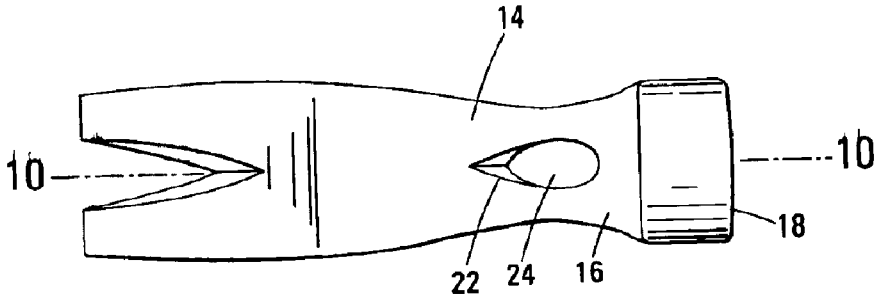
FIG. 2 is a top view of FIG. 1.
Figure 3:
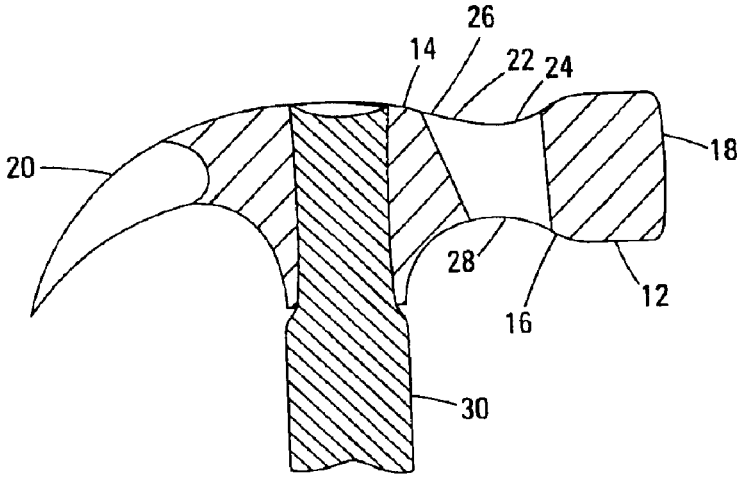
FIG. 3 is a view of the section taken along line 10—10 of FIG. 2.
Figure 4:
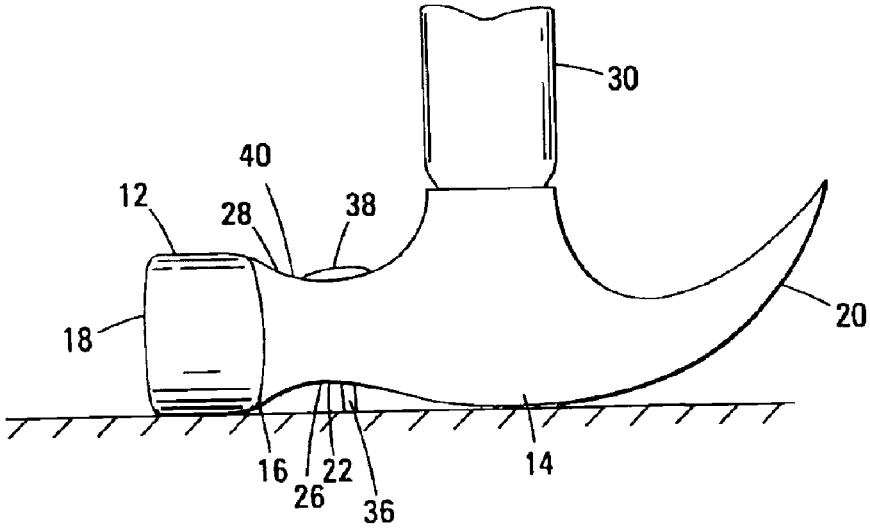
FIG. 4 is a side view of the head of the hammer as it engages the nail after its partial removal by the conventional claw.
Figure 5:
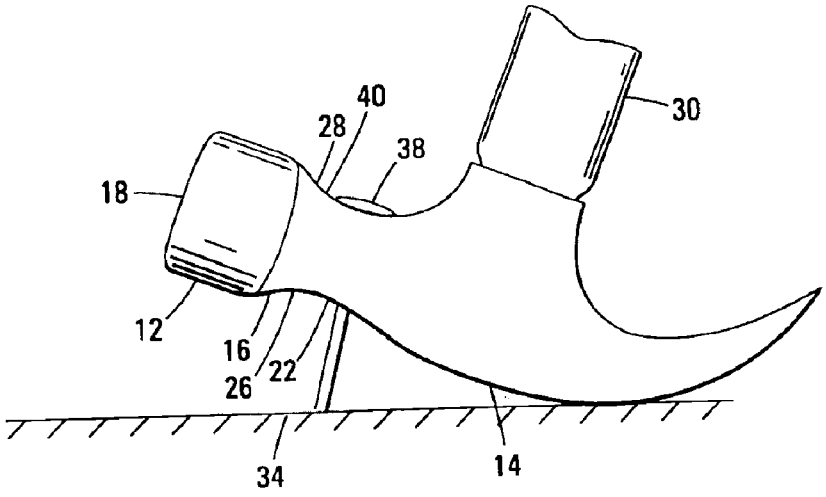
FIG. 5 is a side view of the hammer during the removal of the nail.

The hammer head includes a channel that is capable of receiving a nail that has been partially removed from a substrate. The hammer head is placed over the extended nail so that the nail passes into the channel. The hammer head is then adjusted to fix the nail in position against a side wall of the channel, the surface of the head or a combination thereof. Rotating the handle of the hammer toward the v-claw of the hammer head such that the back side of the v-claw acts as a fulcrum removes the nail from the substrate.

FIGS. 1–5 illustrate a hammer 10 that includes a handle 30 and a head 12 having a body 14, a strike portion 16 that includes a strike face 18, a v-claw 20, and an opening 22 that leads to a channel 24. The channel 24 is positioned in the strike portion 16 of the head 12 in the region of the head 12 between the strike face 18 and the body 14 of the head 12 and extends through the head 12 from one surface 26 of the head 12 to a second surface 28 of the head 12, generally opposite the first surface. A continuous wall in the head defines the channel.

In operation, the exterior surface 26 of the head 12 is positioned against a substrate 34, e.g., wood, and over a nail 36 that has been partially removed from a substrate 34 such that the nail 36 enters the opening 22 and passes through the channel 24 to the second surface 28. The head 12 is adjusted to seat the head 38 of the nail 36 against the surface 28 of the head 12 near the base 40 of the head 12. As the handle 30 is rotated downward in the direction of the v-claw 20, the nail 36 is removed from the substrate 34. The nail head 38 can sit on the shoulder created by the surface 28 of the head surrounding the channel opening. Alternately, the channel can be dimensioned such that a nail sits in the channel and remains stationary due to a friction fit between the nail and the side walls of the channel.

Figure 6:
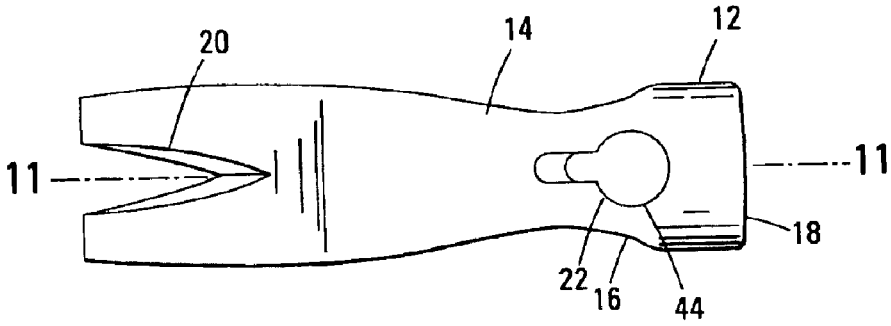
FIG. 6 is a top view of the head of a hammer according to a second embodiment of the invention.
Figure 7:
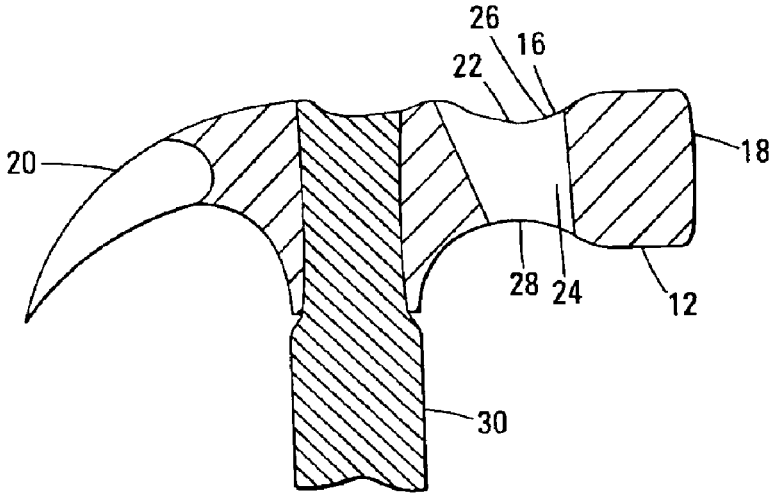
FIG. 7 is a view of the section taken along line 11—11 of FIG. 6.

The opening 22 and channel 24 are illustrated as having a teardrop shape but can be of a variety of shapes including, e.g., oval, keyhole, triangular, slot, diamond, circular, polygonal and combinations thereof. FIGS. 6 and 7, for example, illustrate a hammer head 12 that includes a channel having a keyhole shaped opening 44.

The hammer may be in the form a unitary structure, i.e., the head and handle are formed (e.g., forged) simultaneously. Alternately, the handle and head can be separate components and attached to each other through mechanical or adhesive means. The head and handle can be made from a variety of materials including, e.g., steel, brass, wood, rubber, plastic, composites (e.g., plastic and filler (e.g., fibers, particles and combinations thereof) and combinations thereof.

Figure 8:
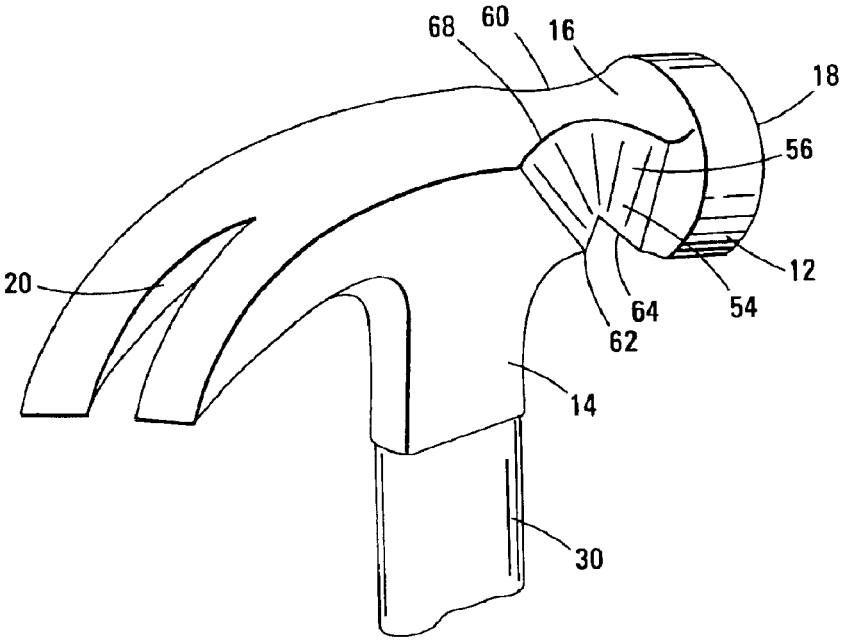
FIG. 8 is a perspective view of a hammer head according to an alternative embodiment of the invention.

In other embodiments, the nail receiving channel is formed on the side of the strike portion of the hammer head such that the channel is exposed. FIG. 8 illustrates a hammer head 12 that includes conical shaped channel 54 formed in the side 56 of the strike portion 16 of the head 12. The channel 54 extends through the head 12 from a first surface 60 of the head 12 to a second surface 62 of the head 12. The channel 54 has tapered side walls 56 and terminates at one end 64 in a v-shaped opening and at a second end 68 in a arcuate opening.

Figure 9:
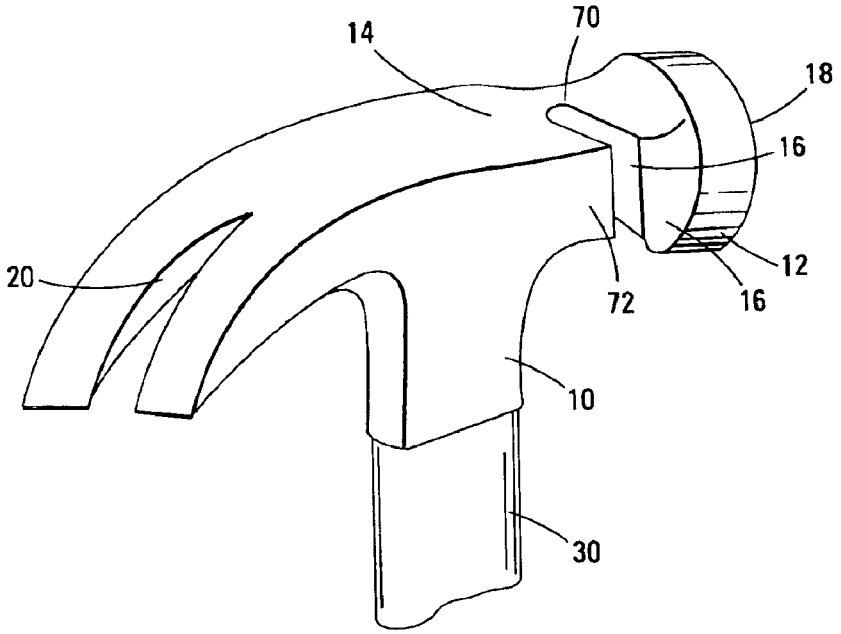
FIG. 9 is a perspective view of a hammer head according to an alternative embodiment of the invention.

FIG. 9 illustrates a hammer head 12 that includes an exposed slot-shaped channel 70 formed on the side 72 of the strike portion 16 of the hammer head 12.

The opening can be located in a variety of positions on the hammer head to optimize the length of nail pull capable of being achieved by a given hammer configuration.

Figure 10:
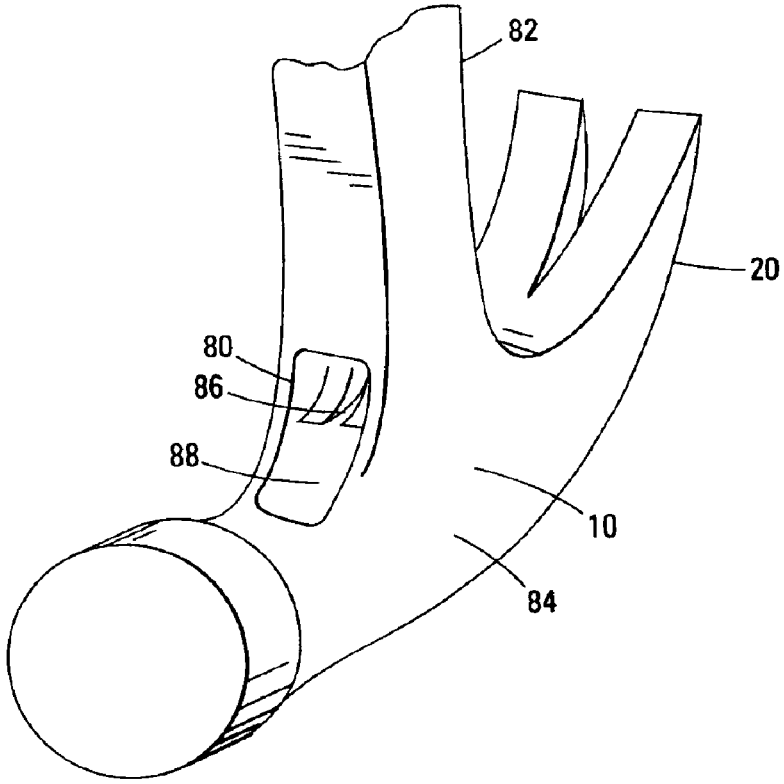
FIG. 10 is a partial perspective view of a nail pulling apparatus according to another embodiment of the invention.
Figure 11:
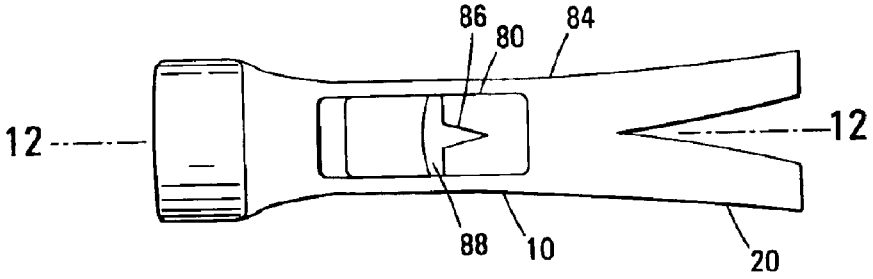
FIG. 11 is a top view of FIG. 10.
Figure 12:
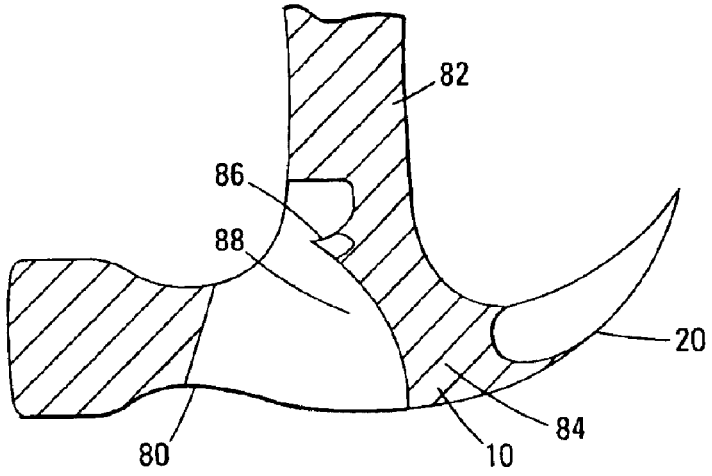
FIG. 12 is a view section taken along line 12—12 of FIG. 11.

FIGS. 10–12 illustrate a hammer head 10 that includes an opening 80 positioned in the body 84 in the area in which the hammer handle 82 is aligned to the body 84. This opening contains a shoulder or second claw 86 positioned in the channel of the opening 88. To remove a nail, the hammer head is positioned over the nail such that the nail is positioned in the opening and manipulated to position the nail head on the shoulder or in the base of the second claw 86. Rotating the hammer downward toward the first claw 20 causes the second claw to pull on the nail, causing the nail to be pulled from the substrate.

Figure 13:
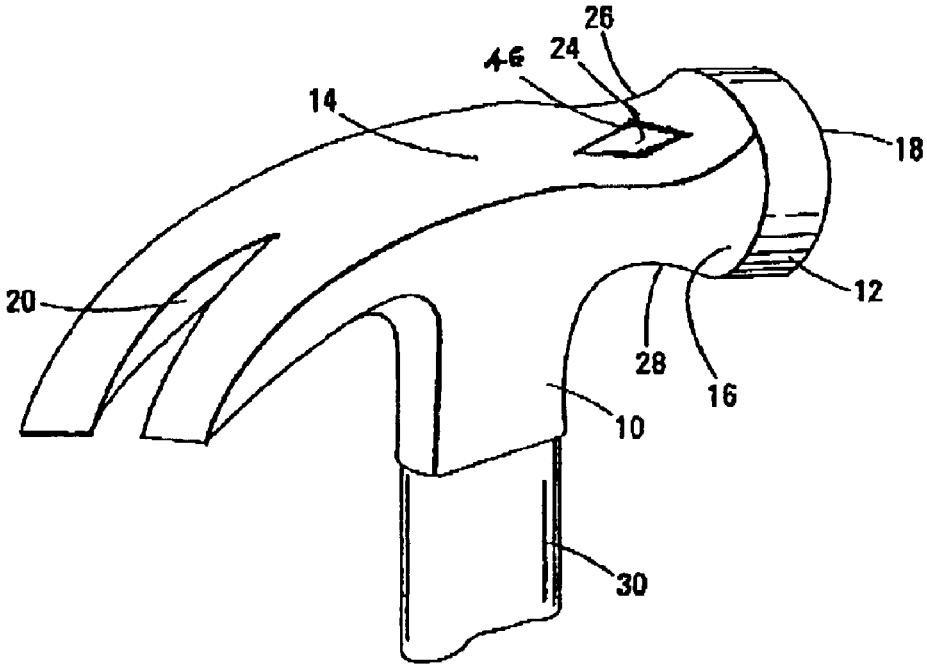
FIG. 13 is a partial perspective view of a hammer head according to an alternative embodiment of the invention.

FIG. 13 illustrates a hammer head 12 that includes a channel having a diamond shaped opening 46.

Other embodiments are within the claims. Although the hammer head has been illustrated as included a standard v-shaped claw other claw configurations are suitable including, e.g., a unitary claw. The claw is preferably at least partially arcuate.

Those skilled in the art will recognize, or be able to ascertain using no more than routine design modifications, many equivalents to the specific invention and preferred embodiments described.

What is claimed is:

1. A hammer comprising:

a handle; and a head comprising a strike face, a claw, a channel extending through said head from a first opening at a first surface of said head to a second opening at a second surface of said head, said channel being defined by a continuous wall and being disposed in a region of said head between said strike face and said claw, said first opening being narrower than said second opening, said handle extending from said first surface of said head.

2. The hammer of claim 1, wherein said channel defines a teardrop shape.

3. The hammer of claim 1, wherein said channel defines a shape selected from the group consisting of key hole, circle, ellipse, oval, and polygon.

4. The hammer of claim 1, wherein said channel defines a triangular shape.

5. The hammer of claim 1, wherein said channel defines a diamond shape.

6. The hammer of claim 1, wherein said channel comprises a v-shaped portion.

7. The hammer of claim 1, wherein said head is integral with said handle.

8. The hammer of claim 1, wherein said handle comprises wood.

9. The hammer of claim 1, wherein said claw is v-shaped.

10. The hammer of claim 1, wherein said handle is attached to said head.

11. A method of using the hammer of claim 1, said method comprising:

placing said head over an extended nail so that said nail passes into the channel;

adjusting said head to fix said nail in position against a side wall of said channel, the surface of the head or a combination thereof;

rotating said handle toward said claw such that the backside of said claw acts as a fulcrum, removing said nail from a substrate.

12. A hammer comprising:

a handle; and a head comprising a strike face, a v-shaped claw, and an exposed channel disposed in a region of said head between said strike face and said v-shaped claw and extending into said head from a first surface of said head, said channel extending from a first opening at a second surface of said head to a second opening at a third surface of said head, said first surface being substantially perpendicular to said second surface, said first opening being narrower than said second opening, said handle extending from said second surface of said head.

13. The hammer of claim 12, wherein said channel is semi-conical.

14. The hammer of claim 12, wherein said channel comprises a slot.

15. The hammer of claim 12, wherein said channel is v-shaped.

16. The hammer of claim 12, wherein said channel is defined by at least one tapering side wall.

17. The hammer of claim 12, wherein said first opening exhibits a v-shape and said second opening exhibits an arcuate shape.

18. A hammer head comprising:

a strike face;

a claw;

a first opening for receiving a handle, said first opening being disposed at a first surface of said hammer head; and a channel extending through said head from a second opening at said first surface of said head to a third opening at a second surface of said head in a region of said head between said strike face and said claw, said second opening being narrower than said third opening, said channel being defined by a continuous wall.

19. A hammer comprising:

a head comprising a strike face, a claw, a channel extending through said head from a first surface of said head to a second surface of said head, said channel being disposed in a region of said head between said strike face and said claw, and a second claw positioned in said channel and extending from an interior wall of said channel; and a handle extending from said first surface of said head.

20. A hammer comprising:

a handle; and a head comprising a strike face, a v-shaped claw, and an exposed channel disposed in a region of said head between said strike face and said v-shaped claw and extending into said head from a first surface of said bead, said channel extending from a second surface of said head to a third surface of said head, said first surface being substantially perpendicular to said second surface, and said channel defining a U-shaped slot.

21. A hammer comprising:

a handle; and a head comprising a strike face, a claw, and a channel extending through said head from a first surface of said head to a second surface of said head, said channel defining a diamond shape and being disposed in a region of said head between said strike face and said claw.

* * * * *